US010144612B2

(12) United States Patent
Stelmack

(10) Patent No.: US 10,144,612 B2
(45) Date of Patent: Dec. 4, 2018

(54) APPARATUS FOR SPOOLING

(71) Applicant: Dale Stelmack, Fort Saskatchewan (CA)

(72) Inventor: Dale Stelmack, Fort Saskatchewan (CA)

( * ) Notice: Subject to any disclaimer, the term of this patent is extended or adjusted under 35 U.S.C. 154(b) by 44 days.

(21) Appl. No.: 14/602,355

(22) Filed: Jan. 22, 2015

(65) Prior Publication Data

US 2016/0214829 A1 Jul. 28, 2016

(51) Int. Cl.

| | |
|---|---|
| ***B65H 54/10*** | (2006.01) |
| ***B65H 54/68*** | (2006.01) |
| ***B65H 75/06*** | (2006.01) |
| ***B65H 75/26*** | (2006.01) |
| ***B65H 75/28*** | (2006.01) |
| ***B65H 75/30*** | (2006.01) |

(52) U.S. Cl.

CPC ..... *B65H 54/106* (2013.01); *B65H 54/68* (2013.01); *B65H 75/06* (2013.01); *B65H 75/26* (2013.01); *B65H 75/305* (2013.01); *B65H 75/28* (2013.01)

(58) Field of Classification Search

CPC ..... B65H 54/60; B65H 54/68; B65H 54/106; B65H 75/06; B65H 75/22; B65H 75/26; B65H 75/265; B65H 75/305; B65H 75/406

See application file for complete search history.

(56) References Cited

U.S. PATENT DOCUMENTS

| | | | | | |
|---|---|---|---|---|---|
| 3,910,513 | A * | 10/1975 | Gelin | B65H 75/26 | 242/118.1 |
| 5,927,635 | A * | 7/1999 | Black | B65H 75/406 | 242/395 |
| 6,015,111 | A * | 1/2000 | Berke | A01K 89/003 | 242/250 |
| 6,102,319 | A * | 8/2000 | Annabel | A01K 89/003 | 242/125.1 |
| 6,276,627 | B1 * | 8/2001 | Brodock | B65H 75/06 | 242/390.8 |
| 7,121,498 | B1 * | 10/2006 | Black | B65H 75/406 | 242/588.2 |
| 7,600,327 | B2 * | 10/2009 | Sharp | G01B 3/1005 | 242/390 |
| 2003/0168546 | A1 * | 9/2003 | Bankston | A01K 89/003 | 242/390.8 |
| 2003/0230507 | A1 * | 12/2003 | Bartlett | B65H 49/38 | 206/419 |
| 2005/0218173 | A1 * | 10/2005 | Hickey | B65H 75/32 | 225/56 |
| 2013/0015283 | A1 * | 1/2013 | Rutten | A01K 89/00 | 242/250 |

* cited by examiner

*Primary Examiner* — William E Dondero
(74) *Attorney, Agent, or Firm* — David W. Barman

(57) ABSTRACT

The present invention is a system for spooling flexible cord, having a spooler body with a central attachment cavity, an arbor connected to said spooler body, a plurality of projections emanating outward from a surface of said arbor, whereby said system is constructed and arranged to rotate and spool said cord.

3 Claims, 4 Drawing Sheets

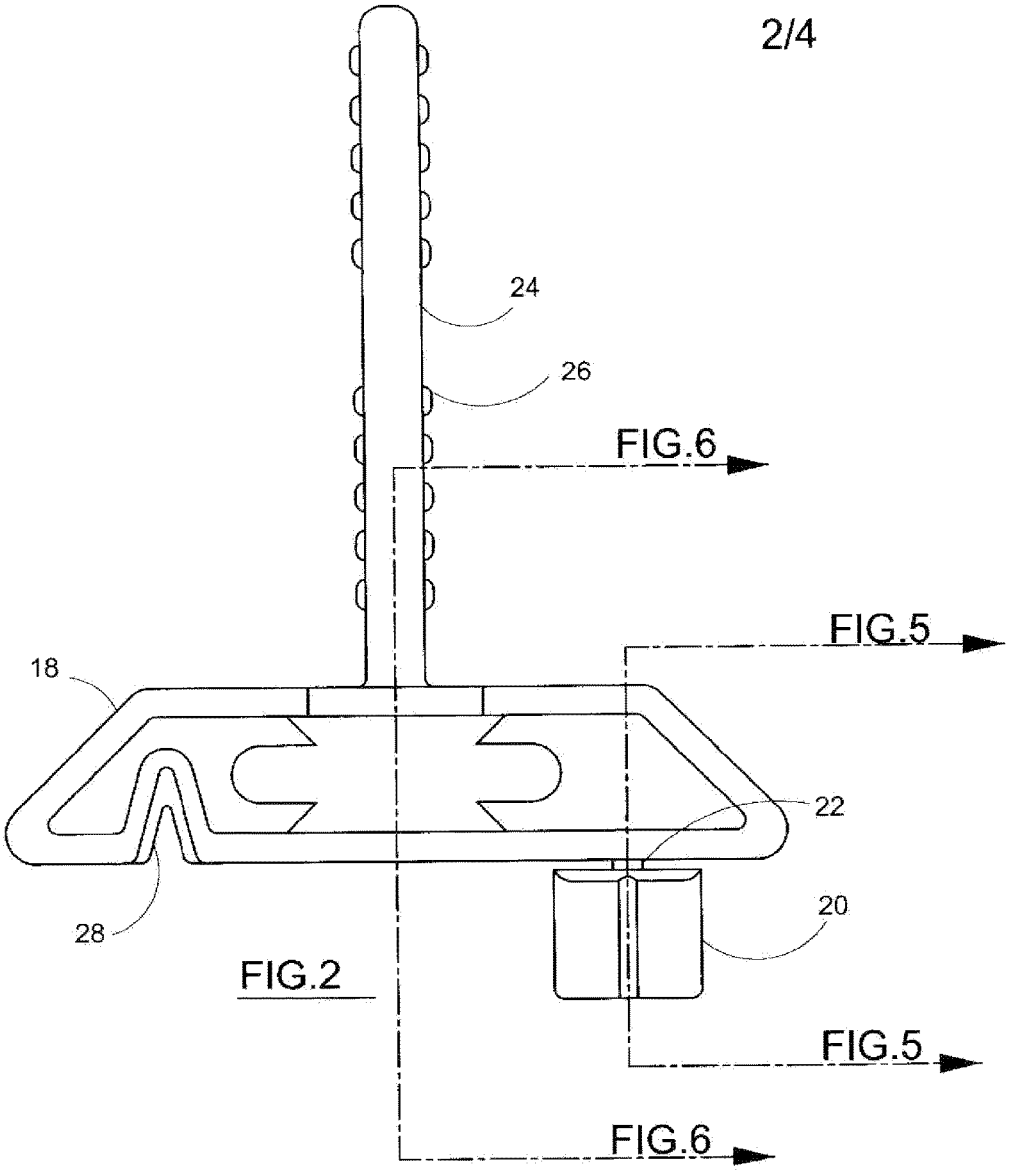
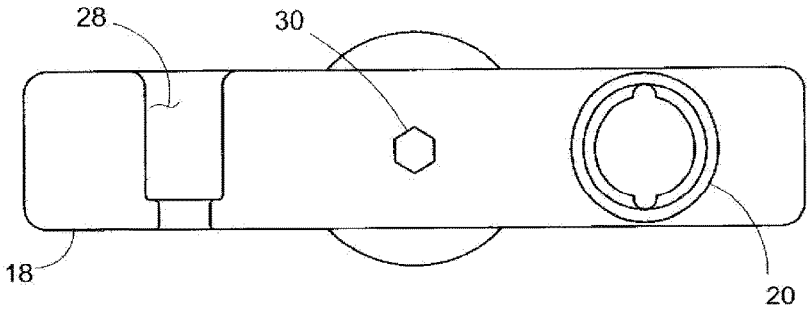
FIG.3

SEE FIG.2

SEE FIG.2

APPARATUS FOR SPOOLING

BACKGROUND OF THE INVENTION

There have been many attempts at providing systems to spool cord and cord-like material. Most of these systems are deficient in failing to provide an adequate way to uniformly create the desired spool. The present invention addresses these deficiencies by providing a system constructed and arranged to produce uniform spooling of cord.

SUMMARY OF THE INVENTION

In one embodiment, the present invention includes adding a standard variable speed drill bit or adding the ability to add a standard variable speed drill bit to a drop line roll up reel to enable use of variable speed drill to wind up line. The invention further contemplates the capability to use a standard variable speed drill with any standard hexagonal driver bit to roll up any cordlike articale such as electrical cable, dropline, and the like. It is contemplated in the present invention that the system provides the ability to use one hand to spool and one hand to guide the coiling of line and achieve no tangles, knots, or weak spots created when line is rolled traditionally (like a garden hose or a kite line.) The line rolls up quicker, straighter, no knots or tangles adds lifespan to tool and drastically shortens roll up time.

In one embodiment, the present invention is a system for spooling flexible cord, said system comprising: a spooler body constructed and arranged with a central attachment cavity; an arbor integral with and connected to said spooler body; a plurality of projections emanating outward from an outer surface of said arbor; whereby said system is constructed and arranged to rotate and spool said cord.

In one embodiment, the arbor is permanently attached to said spooler body.

In one embodiment, the arbor is removably attached to said spooler body.

In one embodiment, the arbor is formed as a unitary piece with said spooler body.

In one embodiment, the projections emanate outward from a central axis of said arbor a distance of between 0.1 to about 1.0 cm.

In one embodiment, the central attachment cavity is constructed and arranged for mounting on an electric drill.

In one embodiment, the central attachment cavity is constructed and arranged for accepting a standard hexagonal driver bit joining the spooler to the power source and allows said power drill to supply spin to said spooler

BRIEF DESCRIPTION OF THE SEVERAL VIEWS OF THE DRAWING

FIG. 2 is a side view of the spooling portion according to one embodiment of the present invention.

FIG. 3 is a bottom view of the spool according to one embodiment of the present invention.

DETAILED DESCRIPTION OF THE PREFERRED EMBODIMENT

Figure 1:
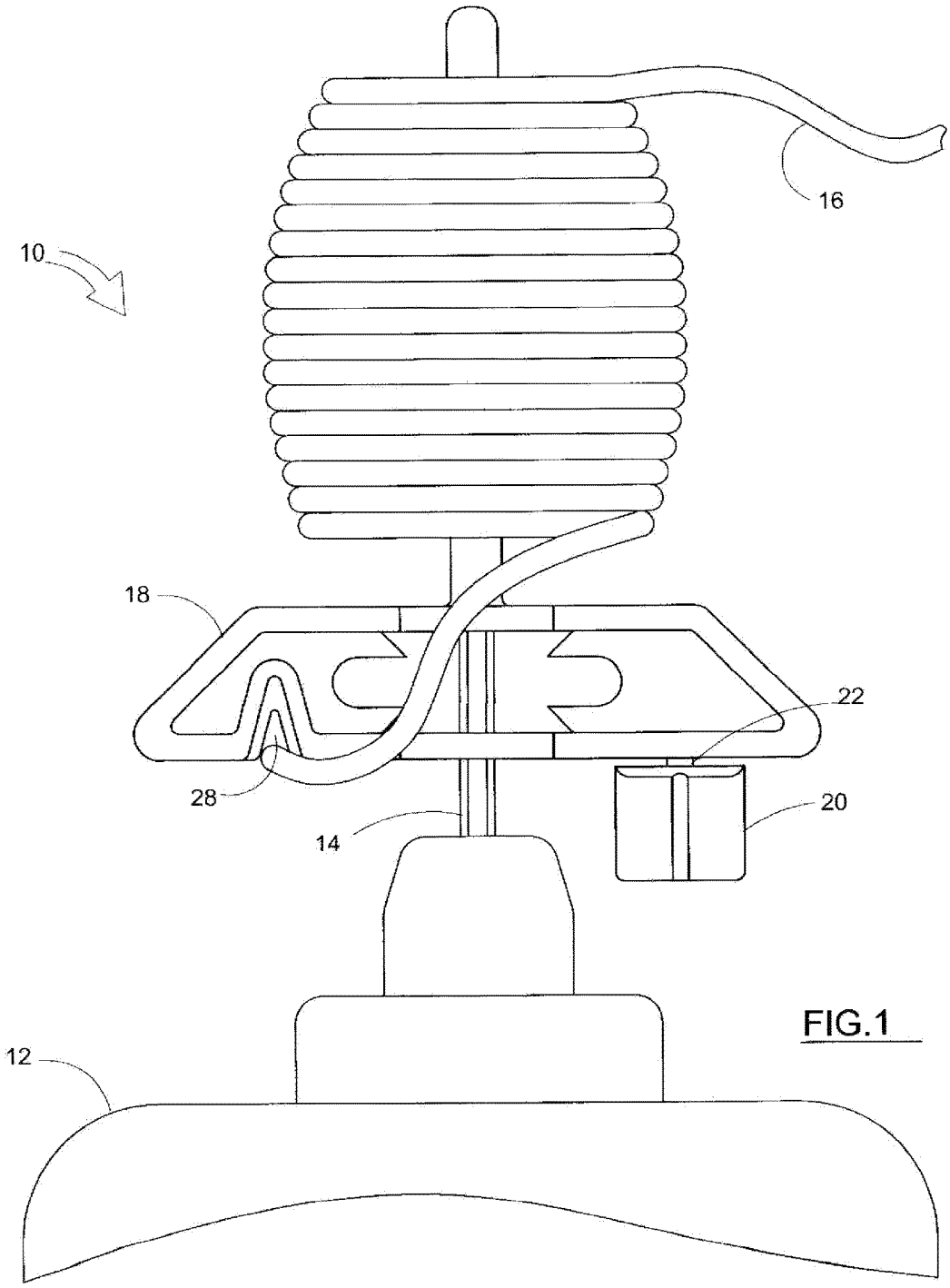
FIG. 1 is a side view of the apparatus according to one embodiment of the present invention.
Figure 4:
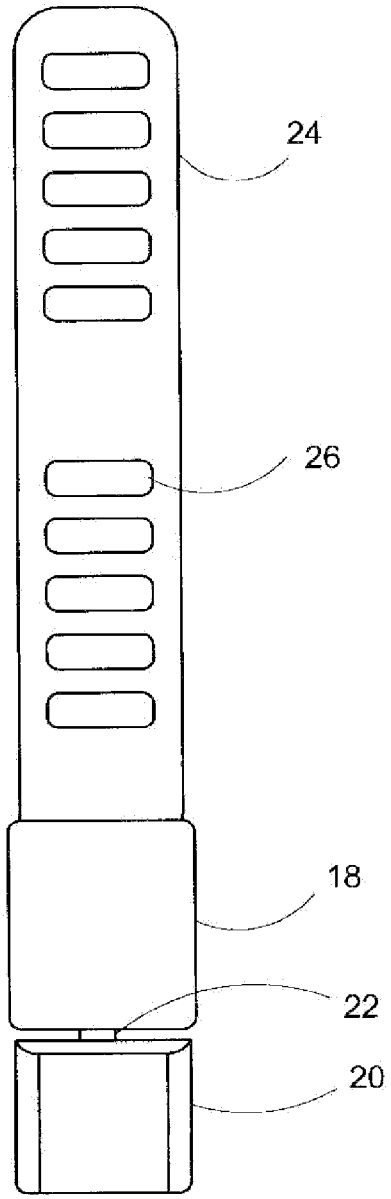
FIG. 4 is a partial side view of the spool body according to one embodiment of the present invention.
Figure 5:
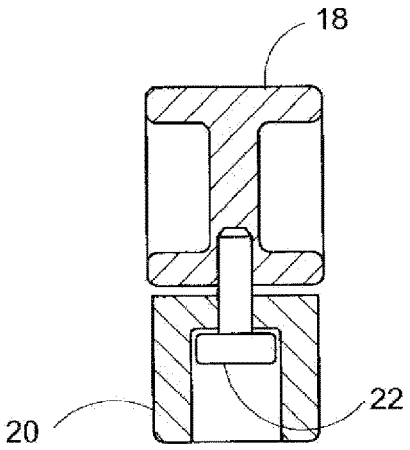
FIG. 5 is a partial cross-section view from FIG. 2.
Figure 6:
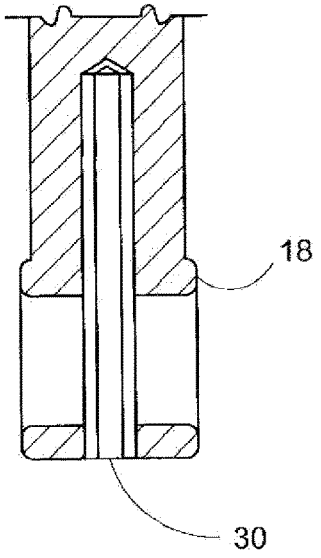
FIG. 6 is a partial cross-section view from FIG. 2.

As generally understood, the present invention involves a spooling system 10 used with a conventional electric drill 12. Drill bit 14 rotates upon actuation of electric drill 12. Spool body 18 is constructed and arranged with a spool guiding cavity 28. Flexible cord 16 is wrapped circularly around arbor 24. Arbor 24 is connected to an integral with spool body 18. Arbor 24 is constructed and arranged with a plurality of coil guides 26. Spool body 18 further includes on its proximal edge a rotary hand motion tab 20 and a hand knob retaining pin 22. Spool body 18 further includes a drill bit connector cavity 30 constructed and arranged for rotating system 10 about a drill bit.

As generally understood, the present invention is suitable for spooling any flexible cord-like material 16. The flexible cord includes but is not limited to electrical cord, electrical wire, yarns, strings, other textile cords, and the like. In use, the user will manually coil several revolutions of cord 16 about arbor 24. The user will then thread cord 16 through cord spooling cavity 28. User will then activate drill 12, causing drill bit 14 to rotate. Upon rotation, cord will be drawn up onto arbor 24 and will spool cord 16 about arbor 24. As cord 16 is spooled, contact will be made with various spooling projections 26 and will provide for uniform spooling of material about arbor 24.

In use, an apparatus of the invention is attached to drill 12. Flexible cord 16 is threaded around shaft or arbor 24 several times until secure. Preferably threading is along spooling projections 26 such that subsequent winds are in contact with successively placed projections/serrations 26. Drill 12 is started and apparatus 10 coils and spools cord 16 until such time as spooling is complete or the drill is stopped.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

What is claimed is:

1. A system for spooling flexible cord, said system comprising: a single spooler body constructed and arranged only with a hexagonal central attachment cavity, a rotary hand motion tab, a hand knob retaining single pin, each of said tab and pin formed on a proximal edge of said spooler body, and a cord spooling cavity; an arbor formed as a unitary piece with said spooler body and having a cantilevered free end; a plurality of projections emanating outward from an outer surface of said arbor; whereby said system is constructed and arranged to rotate and spool said cord when a standard hexagonal drill bit is inserted within said hexagonal central attachment cavity and said hexagonal drill bit attached to a power drill provides support and rotational motion to said spooler body, when said power drill is in use.

2. The system of claim 1 wherein said arbor is permanently attached to said spooler body.

3. The system of claim 1 wherein said projections emanate outward from a central axis of said arbor a distance of between 0.1 to about 1.0 cm.

* * * * *